US009835338B2

(12) United States Patent
Schrock et al.

(10) Patent No.: US 9,835,338 B2
(45) Date of Patent: Dec. 5, 2017

(54) HOOD DEVICES, METHODS, AND SYSTEMS WITH FEATURES TO ENHANCE CAPTURE AND CONTAINMENT

(75) Inventors: Derek W. Schrock, Bowling Green, KY (US); Andrey V. Livchak, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 853 days.

(21) Appl. No.: 12/863,122

(22) PCT Filed: Jan. 19, 2009

(86) PCT No.: PCT/US2009/031415

§ 371 (c)(1),
(2), (4) Date: Jan. 6, 2011

(87) PCT Pub. No.: WO2009/092077

PCT Pub. Date: Jul. 23, 2009

(65) Prior Publication Data

US 2011/0094497 A1 Apr. 28, 2011

Related U.S. Application Data

(60) Provisional application No. 61/022,302, filed on Jan. 18, 2008.

(51) Int. Cl.
*F24C 15/20* (2006.01)

(52) U.S. Cl.
CPC ..... *F24C 15/2028* (2013.01)

(58) Field of Classification Search
USPC ..... 126/299 D, 300; 55/385.2; 261/DIG. 14; 62/234
See application file for complete search history.

(56) References Cited

U.S. PATENT DOCUMENTS

| | | | | |
|---|---|---|---|---|
| 3,270,655 | A * | 9/1966 | Guirl et al. | 454/188 |
| 3,397,631 | A * | 8/1968 | Simons | 454/190 |
| 3,890,887 | A * | 6/1975 | Kaufman et al. | 126/299 D |
| 4,467,782 | A * | 8/1984 | Russell | 126/299 D |
| 4,669,373 | A * | 6/1987 | Weimer et al. | 99/349 |
| 4,856,419 | A * | 8/1989 | Imai | 454/49 |

(Continued)

FOREIGN PATENT DOCUMENTS

| | | |
|---|---|---|
| CH | 682512 A5 | 9/1993 |
| CN | 2128999 | 3/1993 |

(Continued)

OTHER PUBLICATIONS

Office Action dated May 31, 2012, in Canadian Patent Application No. 2,712,310.

(Continued)

*Primary Examiner* — Jason Lau
(74) *Attorney, Agent, or Firm* — Potomac Law Group, PLLC; Mark Catan

(57) ABSTRACT

A device that augments the capture and containment of an exhaust hood using jets is retrofitable to existing exhaust hoods. The device, in embodiments, forms a self-contained system that is separate from the hood and can be installed in existing hoods providing them with increased performance. Various embodiments are shown which are suitable for canopy and backshelf hood designs.

13 Claims, 4 Drawing Sheets

(56) References Cited

U.S. PATENT DOCUMENTS

| | | | | |
|---|---|---|---|---|
| 5,160,517 | A * | 11/1992 | Hicks et al. | 55/385.1 |
| 6,044,838 | A | 4/2000 | Deng | |
| 6,450,879 | B1 | 9/2002 | Suen | |
| 6,626,971 | B1 * | 9/2003 | Forbert et al. | 55/385.2 |
| 6,899,095 | B2 | 5/2005 | Livchak et al. | |
| 6,912,864 | B2 * | 7/2005 | Roche et al. | 62/256 |
| 2006/0032492 | A1 * | 2/2006 | Bagwell et al. | 126/299 R |
| 2006/0090746 | A1 | 5/2006 | Lee | |
| 2006/0254430 | A1 * | 11/2006 | Nevarez et al. | 99/349 |
| 2007/0015449 | A1 | 1/2007 | Livchak | |
| 2007/0272230 | A9 | 11/2007 | Meredith et al. | |

FOREIGN PATENT DOCUMENTS

| | | | |
|---|---|---|---|
| CN | 2211026 | | 10/1995 |
| CN | 1928440 | A * | 3/2007 |
| DE | 8301489 | | 6/1983 |
| EP | 1637810 | | 3/2006 |
| JP | 54-147647 | | 11/1979 |
| JP | 63-286640 | | 11/1998 |
| JP | 2005-214583 | | 8/2005 |
| JP | 2007-292388 | | 8/2007 |

OTHER PUBLICATIONS

Extended European Search Report and Search Opinion dated Aug. 8, 2011, in European Patent Application No. 09 70 1561.

Halton drawings, "Model KVL Fryer Hood", Nov. 18, 1998.

Halton drawings, "Model KVL Kitchen Hood Layout", Sep. 21, 1998.

Office Action dated Sep. 25, 2012, in Australian Application No. 2009205965.

Office Action dated Sep. 18, 2012, in Japanese Patent Application No. 2010-543302.

Office Action dated May 10, 2016 in European Patent Application No. 9701561.4.

Office Action for European Application No. 09 701 561.4 issued Jul. 3, 2017.

* cited by examiner

HOOD DEVICES, METHODS, AND SYSTEMS WITH FEATURES TO ENHANCE CAPTURE AND CONTAINMENT

CROSS REFERENCE TO RELATED APPLICATIONS

The present application is a national stage application of International Application No. PCT/US09/31415, filed Jan. 19, 2009, which claims the benefit of U.S. Provisional Application No. 61/022,302, filed Jan. 18, 2008, both of which are incorporated by reference herein in their entireties.

SUMMARY

The present embodiments relate to exhaust hoods, features associated with exhaust hoods, and combinations thereof, the features providing air jets that enhance capture efficiency. The embodiments also relate to mechanisms for retrofitting the features to pre-existing exhaust hoods.

Disclosed embodiments include a device for enhancing capture of fumes by a backshelf-type exhaust hood with at least one side panel. The hood has a recess with an access, the access has a forward edge portion along the hood-proper and at least one side edge portion along the at least one side panel. The device includes a fan module attachable to the hood. The fan module has distribution plenum portions including at least a first portion, a bend, and a second portion that are interconnectable to form a continuous sealed channel such that air provided by the fan module flows through the first portion to the second portion. The distribution plenum portions are configured to be attachable, respectively, to the forward and side edges such that they can be interconnected with the bend therebetween and such that they extend along hood forward edge portion and side edge portion. The distribution plenum portions has orifices arranged to form curtain jets emanating from the forward edge portion and side edge portion. The distribution plenum portions are separate from the hood such that they can be fitted to an existing hood. The curtain jet emanating from the forward edge has a downwardly directed vertical component. The curtain jet emanating from the side edge is horizontally-directed aimed and toward a blind end of the recess.

In a variation, the fan module includes an ambient air inlet grill and fan to draw ambient air through the grill and discharge it into the distribution plenum. The fan module may further include a flow rate controller configured to vary a flow rate of the ambient air discharged thereby. The first and second portions may have directable nozzles that permit the direction of the curtain jets to be changed.

Disclosed embodiments also include a device for enhancing capture of fumes from a cooking appliance into an exhaust hood. The exhaust hood has a recess with an access positioned above the cooking appliance, and at least a forward edge and two descending side edges. The device includes a capture augmentation device to generate and direct a first curtain jet along the forward edge of the exhaust hood, a second curtain jet along at least a part of one of the two descending side edges of the exhaust hood, and a third curtain jet along at least a part of the other of the at least two descending side edges of the exhaust hood. The first, second and third curtain jets are directed so as to induce flow of contaminated air into the exhaust hood and to increase containment of the forward edge and the at least two descending side edges of the exhaust hood. The capture augmentation device is configured to direct the first curtain jet in a direction which is between a horizontal and a vertical direction. The second and third curtain jets each have direction which corresponds to the shape of the descending edge and their position therealong.

The capture augmentation device may include a plenum module with a plurality of apertures and a first portion positioned at a forward edge of the exhaust hood, a second portion positioned at one of the descending side edges of the exhaust hood, and a third portion positioned at the other descending side edge of the exhaust hood; and a fan module to force ambient air toward the plenum module. The first, second and third curtain jets may be generated by discharging pressurized ambient air from the first, second and third portions of the plenum module respectively through the plurality of apertures. The fan module may include a mechanism for changing a flow rate of the ambient air moving toward the plenum module.

Disclosed embodiments also include a device for enhancing capture of contaminated air rising from a cooking appliance toward an exhaust hood where the exhaust hood has a recess with an access positioned above the cooking appliance. The device includes a capture augmentation device including a tubular portion positioned along an inner surface of at least one side of the exhaust hood to generate and direct a first curtain jet in a substantially vertical direction to increase containment of the at least one side of the exhaust hood, and a second curtain jet directed in a substantially horizontal direction to induce flow of contaminated air into a main flow in the exhaust hood. The capture augmentation device further includes a fan module positioned on an outer surface of the exhaust hood so as to force ambient air into the tubular portion.

Disclosed embodiments also include a device for enhancing capture of fumes by a canopy-type exhaust hood with at least one side panel, the hood having a recess with an access, the access has a an edge adjacent the access. The device includes a fan module attachable to the hood. The fan module has a distribution plenum portions including at least a first portion, a bend, and a second portion that are interconnectable to form a continuous sealed channel such that air provided by the fan module flows through the first portion to the second portion. The distribution plenum portions are configured to be attachable, respectively, inside the recess and adjacent the edge such that they can be interconnected with the bend therebetween and such that they extend along the edge. The distribution plenum portions have orifices arranged to form curtain jets. The distribution plenum portions are separate from the hood such that they can be retrofitted to an existing hood. At least one of the distribution plenum portions are connected to the elbow by a pivotable connection to permit the curtain jet to be directed in a selected direction in a range that includes the horizontal, the vertical, and at least one position therebetween.

The fan module may include an ambient air inlet grill and fan to draw ambient air through the grill and discharge it into the distribution plenum. The fan module may further include a flow rate controller configured to vary a flow rate of the ambient air discharged thereby. The first and second plenum portions may be cylindrical with circular cross-sections.

Disclosed embodiments also include an exhaust device for capturing contaminated air from a cooking appliance including an exhaust hood has a forward top edge and at least two descending side edges which define an exhaust hood perimeter with a recess therein. The exhaust hood recess has an access positioned above the cooking appliance and a capture augmentation device, which generates curtain jets along at least a portion of the exhaust hood perimeter, attached to the forward top edge of the exhaust hood. The curtain jets are shaped and directed so as to induce flow of contaminated air from the cooking appliance into the exhaust hood recess. The capture augmentation device includes a distribution channel extending along at least a portion of the exhaust hood perimeter. The distribution channel has a plurality of apertures. A fan module flows ambient air into the distribution channel and through the apertures thereof so as to generate the curtain jets. The apertures of the distribution channel may form a substantially straight line across straight portions of a length of the distribution channel. The distribution channel may be attached to the forward top edge of the exhaust hood so as to generate a first curtain jet has a direction which is between a horizontal and a vertical direction. The distribution channel further extends along at least a portion of each of the at least two descending side edges generating a second and a third curtain jet, respectively. The distribution channel has a circularly cylindrical shape. S flow control device may control a flow rate of the ambient air flowing into the distribution channel. The capture augmentation device may be detachable from the exhaust hood.

Disclosed embodiments also include an exhaust device for capturing contaminated air from a cooking appliance, the exhaust device including an exhaust hood with a top wall and a plurality of side walls which define a perimeter with a recess therein. The recess has an access positioned above the cooking appliance. A capture augmentation device is positioned so as to generate and direct curtain jets along at least a portion of the perimeter such that contaminated air is flowed into the exhaust hood recess. The capture augmentation device includes a distribution channel positioned within the recess such that the distribution channel extends along and substantially parallel with an inside surface of at least one of the plurality of side walls. The distribution channel including a plurality of apertures; and a fan module arranged external to the exhaust hood and configured to provide pressurized ambient air to the distribution channel, wherein the curtain jets are generated by discharging the pressurized ambient air through the apertures of the distribution channel. The distribution channel is offset in an upward direction from a bottom edge of the inner surface and is offset in a horizontal direction from the inner surface. The plurality of apertures may be positioned so as to direct a first curtain jet in a vertical direction toward the cooking appliance and a second curtain jet in a horizontal direction toward the inside of the exhaust hood. The distribution channel may have a circular cross-section shape or a rectangular or other prismatic shape. The exhaust hood may include at least two inner surfaces meeting at at least one corner, and the direction of the first and second curtain jets proximate the corner can be intermediate between respective directions of the first and second curtain jets remote from the corner. The distribution channel may be configured to be tilted.

Disclosed embodiments also include an exhaust enhancement apparatus for an exhaust hood. The exhaust hood has a plurality of edges which define a perimeter with a recess therein for capturing contaminated air from a cooking appliance. The exhaust enhancement apparatus includes a distribution channel configured to be attached to and extend entirely along at least one of the exhaust hood edges. The distribution channel has an inlet and a plurality of apertures extending along a length thereof. An ambient air supply is configured to supply the distribution channel inlet with a pressurized supply of ambient air. The exhaust enhancement apparatus produces at least one curtain jet by flowing the pressurized air through the distribution channel and out through the plurality of apertures. The ambient air supply may include a fan module.

Disclosed embodiments also include an exhaust enhancement apparatus for an exhaust hood, the exhaust hood having a top wall and a plurality of side walls which define a perimeter with a recess therein. The recess has an access positioned above the cooking appliance. The exhaust enhancement apparatus includes; a distribution channel configured to be attached within the recess so that it extends along and substantially parallel with an inside surface of at least one of the plurality of side walls. The distribution channel includes a plurality of apertures. A fan module is configured to be arranged external to the exhaust hood to provide pressurized ambient air to the distribution channel. The exhaust enhancement apparatus generates at least one curtain jet by discharging pressurized ambient air through the apertures of the distribution channel. The at least one curtain jet may have a substantially vertical direction. A first curtain jet may have a substantially vertical direction and a second curtain jet may have a substantially horizontal direction. The distribution channel may have a circularly cylindrical shape. The distribution channel may extend along an entire perimeter of the exhaust hood.

BRIEF DESCRIPTION OF DRAWINGS

The foregoing and other aspects, features, and advantages of the present invention will be better appreciated from the following description of the embodiments, considered with reference to the accompanying drawings, wherein.

DETAILED DESCRIPTION

Exhaust hoods for ventilation of pollutants from cooking appliances, such as ranges, promote capture and containment by providing a buffer zone above the pollutant source where buoyancy-driven momentum transients can be dissipated before pollutants are extracted. By managing transients in this way, the effective capture zone of an exhaust supply can be increased.

The effective capture and containment capability of the exhaust hood can be enhanced by the use of air curtain jets positioned around a perimeter of the exhaust hood. The particular range of velocities, positioning, and direction of the jets in combination with a shape of the exhaust hood, can create an enhanced buffer zone below the hood and can induce flow of contaminated air into the exhaust hood. This can reduce the volume of flow of air required to ensure full capture and containment.

Figure 1:
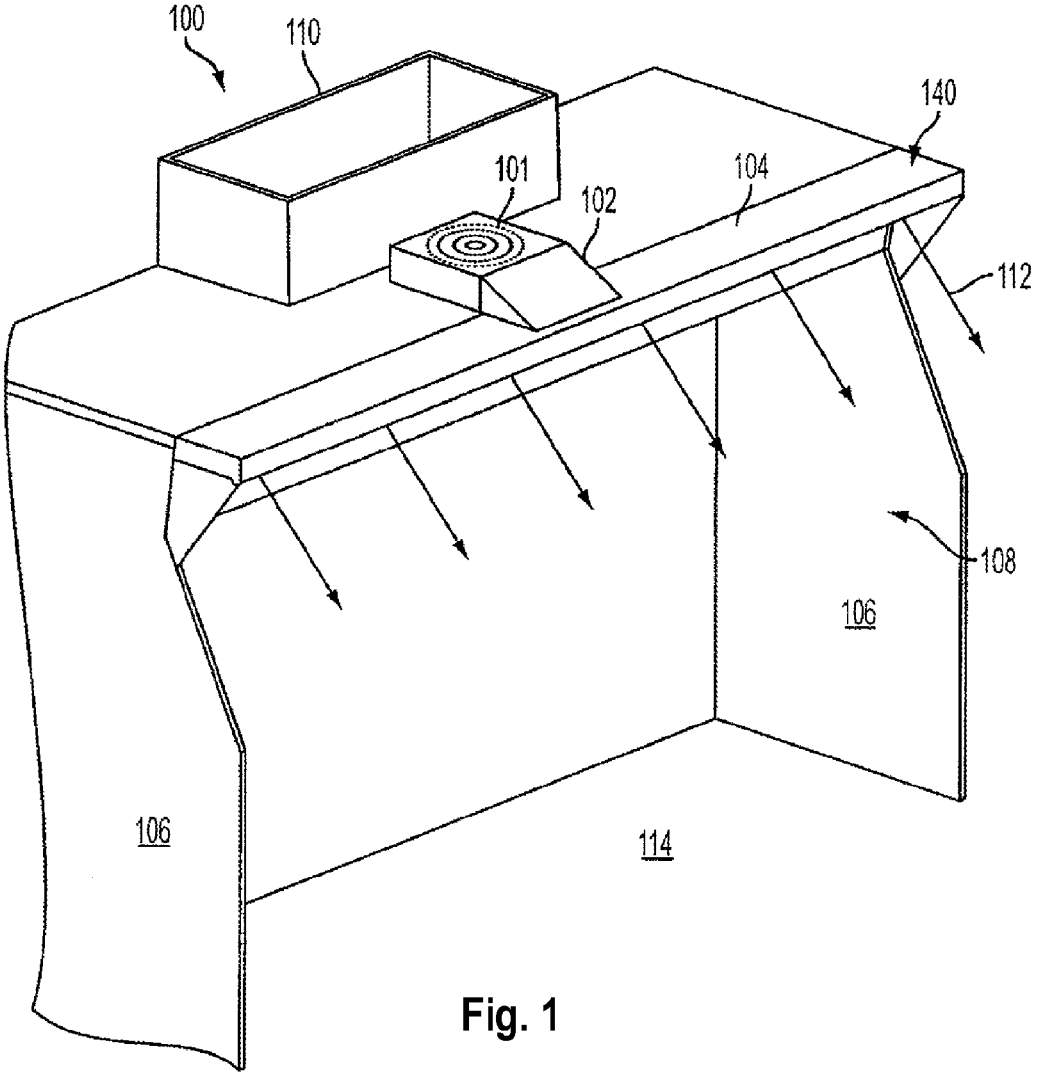
FIG. 1 is a perspective view of a back-shelf style exhaust hood according to an embodiment of the invention.

Referring to FIG. 1, an exhaust hood 100 has side skirts 106 and an exhaust collar 100 which is connectable to an exhaust duct (not shown) such that air and fumes are drawn into a recess 108 and out through the exhaust collar 110. A retrofit discharging module 140 has a fan module 101 containing a blower (not shown), that draws ambient room air into a duct 102 and passes the air into a distribution channel 104 pressurizing it such that air issues from an array of holes in the distribution channel 104 as individual air jets that expand due to air entrainment and coalesce a short distance thereafter to form a curtain jet 112. A cooking appliance top surface is indicated at 114. The retrofit discharging module 140 is attached to the exhaust hood 100 at its forward edge and requires only electrical connections to operate. Preferably, the fan module 101 is provided with a flow controller, such as a damper or a speed controller, to permit the flow rate to be adjusted to fit the operating conditions of the hood 100 exhaust flow rate. Preferably, the distribution channel 104 is a plenum. The holes (apertures) in the plenum 104 can be arranged so as to form substantially a straight line across a length of the plenum 104. The size of the holes and the distance between them can vary based on the particular application. The discharging plenum 104 can be configured to be tilted with respect to the forward edge of the exhaust hood. This can change the direction in which the holes are facing the cooking appliance, and thus the direction of the curtain jet 112. The direction of the curtain jet 112 can be changed to be anything between a substantially vertical and a substantially horizontal direction.

Figure 2:
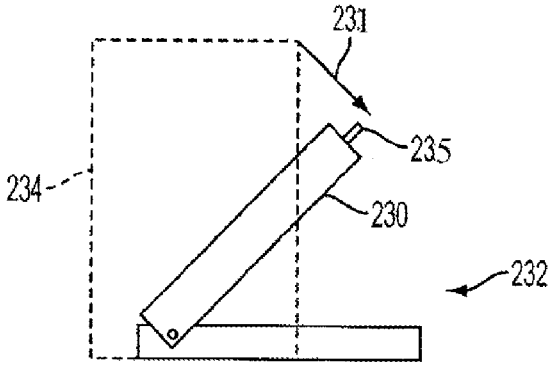
FIG. 2 is a cross-sectional representation of the exhaust hood of FIG. 1 used with a platen-grill cooking appliance.

In the embodiment of FIG. 2, the curtain jet 231 is shown forming an angle intermediate between the vertical and horizontal. This configuration may be used in embodiments where the exhaust hood 234 protects a platen grill 232 having a platen 230. The angle may be chosen such that the jet 112 clears a forward edge 235 of the platen 230 when the platen 230 is in a raised position.

Figure 3:
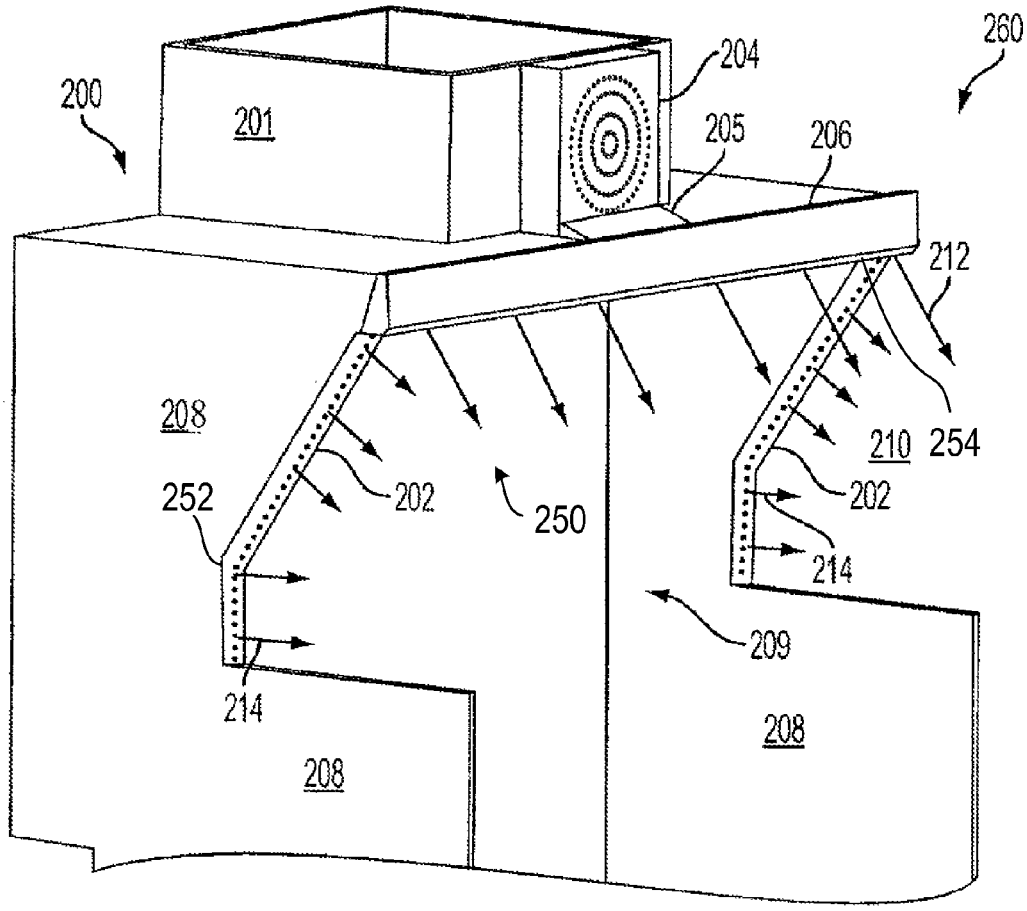
FIG. 3 is a perspective view of a back-shelf style exhaust hood according to another embodiment of the invention.

Referring to FIG. 3, an exhaust hood 200 has side panels (the panels are sometimes called skirts) 208 and an exhaust collar 201 which is connectable to an exhaust duct (not shown) such that air and fumes are drawn into a recess 209 and out through the exhaust collar 201. A capture augmentation device 260 has a fan module 204 containing a blower (not shown separately), that draws ambient room air into a duct 205 and passes the air into a distribution plenum 206 such that the air issues from an array of holes in the plenum 206 forming a curtain jet 212. The plenum 206, and similar elements with jet-forming holes in them, is also referred to as a header. A cooking appliance, such as a fryer or other kitchen appliance, may be located beneath the recess 209.

The capture augmentation device 260 is attached to the hood 200 at its forward edge and requires only electrical connections to operate. Preferably, the fan module 204 is provided with a flow controller, such as a damper or a speed controller, to permit the flow rate to be adjusted to fit the operating conditions of the hood 200 exhaust flow rate. A perimeter 250 of the exhaust hood includes a forward edge 254 and at least one descending side edge 252 of the hood. The side skirts 208 of this embodiment have cut-out areas 210 shaped and sized to permit cooking implements, such as fryer baskets to be moved away from the fryer (not shown) which would reside below the recess 209.

Descending plenums 202 with arrays of holes are connected to receive air from the plenum 206 and thereby form curtain jets 214 as shown. The curtain jets 214 effectively extend the effect of the side skirts 208 into the recess areas 210. The direction of the curtain jets may be altered according to various embodiments. For example, the curtain jets 214 can be partially directed toward the opposite side panel 208 (that is, inwardly toward the middle of the recess) rather than parallel to the side panel 208 (i.e., in the plane of panel 208).

Figure 4:
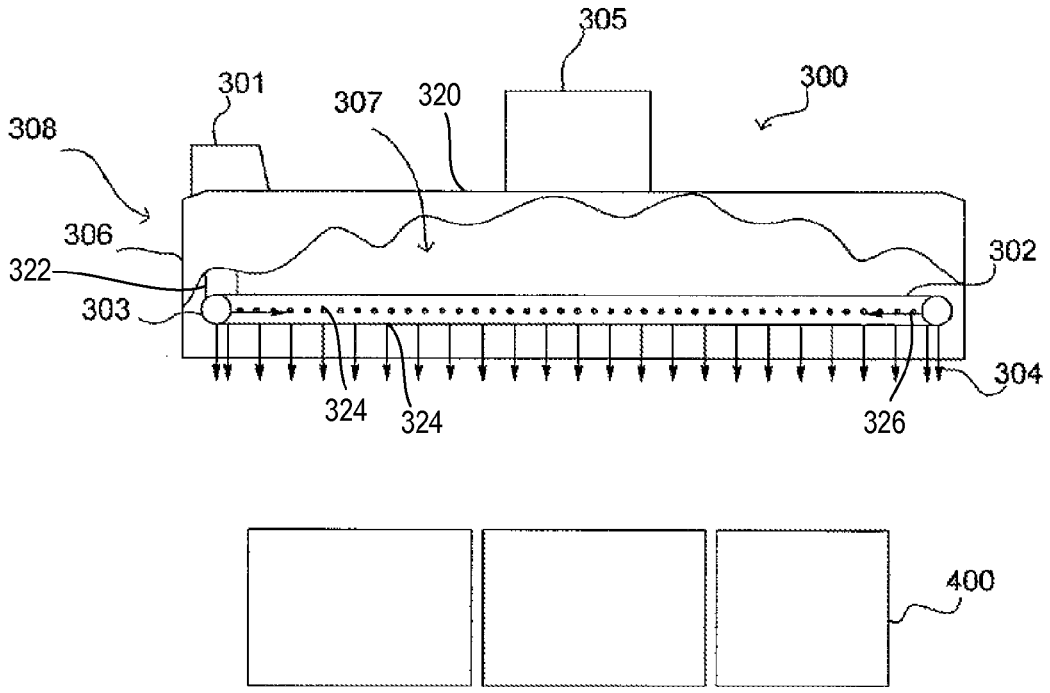
FIG. 4 is a partial cutaway view of a canopy-style exhaust hood with a capture augmentation device installed therewithin.
Figure 6:
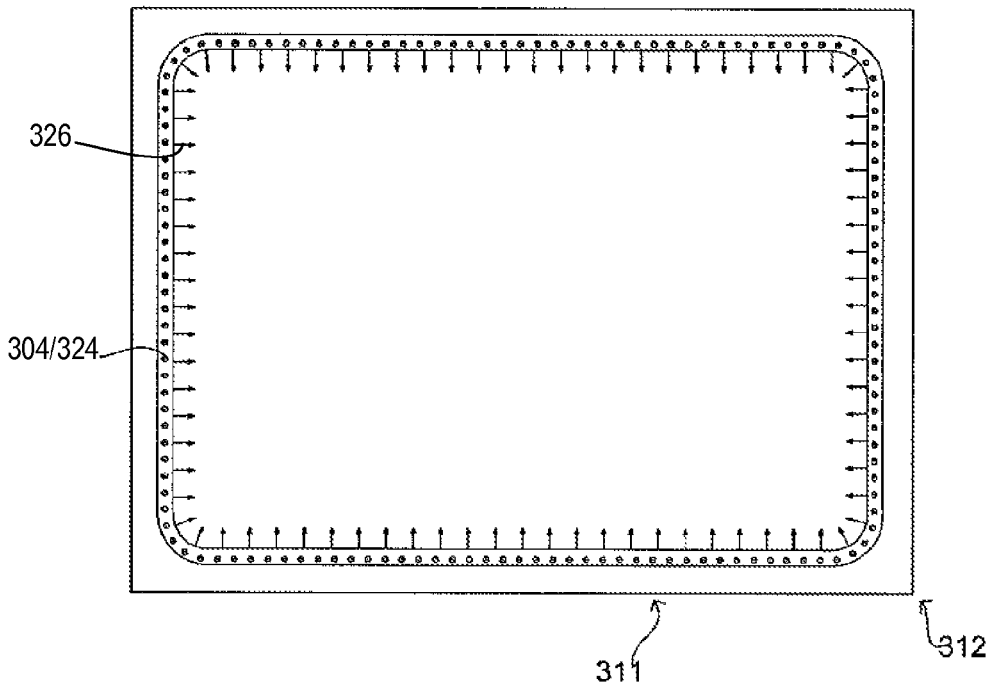
FIG. 6 is a bottom plan view looking up toward a canopy at a distribution header.

Referring to FIG. 4, an exhaust hood 300 has side walls 306 and a top wall 320 that together defines a recess 307 enclosed on all sides but an underside facing the one or more cooking appliances 400. The hood 300 has an exhaust collar 305 which is connectable to an exhaust duct (not shown) such that air and fumes are drawn into the recess 307 and out through the exhaust collar 305. A capture augmentation device 308 has a fan module 301 containing a blower (not shown separately), that draws ambient room into a duct 322 and passes the air into a distribution plenum 302 pressurizing it such that the air issues from an array of holes (for example, hole 324) forming vertical and horizontal curtain jets 304 and 326, respectively. The distribution plenum 302 has a cylindrical cross-section with straight and curved portions such that all sides of the canopy hood can be provided with the curtain jets shown. Preferably, the fan module 301 is provided with a flow controller (not shown), such as a damper or a speed controller, to permit the flow rate to be adjusted to fit the operating conditions of the hood 300 exhaust flow rate. The distribution plenum 302 can be cylindrical as indicated at 303 with the array of holes 324 arranged in one or more substantially straight rows across a length of the plenum 302.

Figure 5:
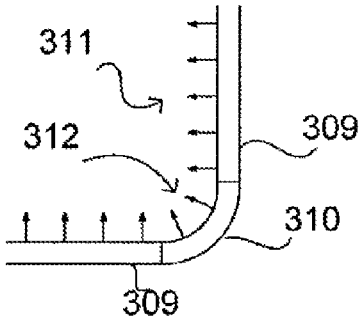
FIG. 5 is a view of a part of a distribution plenum (or header) from a bottom or top view showing a curved elbow portion and two straight portions of the plenum.

Referring also to FIG. 5, the distribution plenum 302 is positioned within the recess 307 so as to extend along and substantially in parallel with the inside facing surface of at least one of the side walls 306. The tube 302 can be connected to the fan module 301 which is arranged external to the exhaust hood 300. The distribution plenum 302 can be offset upwardly from the bottom edge of the side wall and be offset horizontally from the inside surface of the side wall. The distance by which the discharging tube is offset from the edge and the side wall can vary depending on the application. In this embodiment the plurality of holes are positioned in a straight line facing the cooking appliance, so that the curtain jet 304 generated can be directed downwardly toward the cooking appliance in a substantially vertical direction. In another embodiment, the discharging tube 302 can have a second set of plurality of holes positioned along the length of the tube 302, such that the first set of holes is substantially perpendicular to the second set of holes. In this case, a second curtain jet 311 is generated facing the inside of the recess 307 in a direction which is substantially horizontal. The exhaust hood may be a canopy-style hood. In alternate embodiments, the tube 303 may be formed of a plurality of sections 400 each connectable to its own fan module 301, as shown in FIG. 5.

Figure 7:
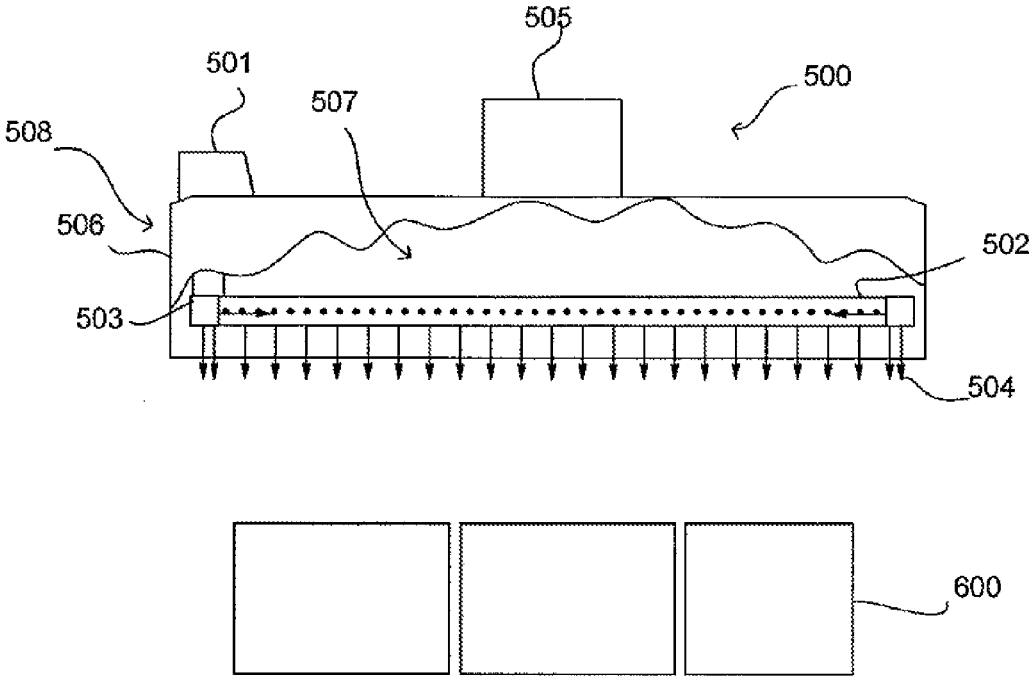
FIG. 7 is a partial cutaway view of a canopy-style exhaust hood with a capture augmentation device installed therewithin.

Referring to FIG. 5, the distribution plenum 302 is tube positioned to extend along at least two adjacent inside surfaces of the exhaust hood 300 meeting at at least one corner. In this embodiment the distribution channel 302 has at least two straight tube portions 309 each extending along a respective inside surface of the exhaust hood 300. The two portions 309 are connected to each other through a curved tube portion 310 (or elbow). The curtain jet 311 generated in each of the straight tube portions 309 has a direction which is substantially horizontal and the curtain jet 312 generated in the curved tube portion 310 in angled relative to the direction of the curtain jet 311. Each of the straight tube portions 309 can be tilted relative to the curved tube portion 310. By tilting the straight tube portions 309, the direction of the curtain jet 311 can be changed. Referring to FIG. 7, the distribution channel 302 is positioned so as to extend along the entire perimeter of the recess 307. The distribution channel may be a tube. In this embodiment, the ambient air forced into one end 303 of the tube 302 may flow throughout the entire tube 302 so as to circumnavigate the entire exhaust hood 300 and generate curtain jets 311 and 312.

Figure 8A:
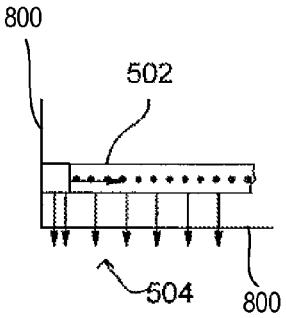
FIGS. 8A through 8C show different possible positions for distribution header portions within a canopy hood.
Figure 8B:
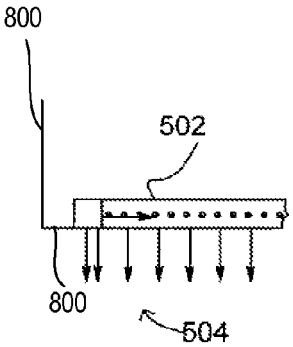
Figure 8C:
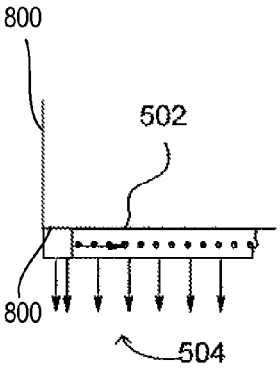

In the embodiment of FIG. 8, the distribution plenum 502 has a box-shaped cross-section as indicated at 503. Other features are conform to the description of FIG. 4. FIGS. 8A, 8B, and 8C show various locations for the distribution plenum 502 (or 302). The plenum may be hung by hangers from within the canopy such that it does not touch the interior wall of the canopy as shown in FIGS. 4 and 7. Alternatively, it can be attached as shown in the FIGS. 8A and 8C to the hood 820 interior. Alternatively it can be hung by hangers (similar to pipe hangers, for example) such that it is at the level of the lower edge 802 of the hood 800. In FIG. 8C, the distribution plenum is shown below the lower edge 802 of the hood 800.

It should be understood that the present invention is not limited to the embodiments described herein. Rather, those skilled in the art will appreciate that various changes and modifications can be made in keeping with the principles exemplified by the illustrative embodiments.

What is claimed is:

1. An exhaust enhancement apparatus for an exhaust hood, the exhaust hood having a plurality of edges which define a perimeter with a recess therein for capturing contaminated air from a cooking appliance, the exhaust enhancement apparatus comprising:

a plenum, with a distribution channel, configured to be attached to and extend entirely along at least a front edge of the exhaust hood edges, the plenum having an inlet and a plurality of apertures extending along a length thereof; and an ambient air supply configured to supply the plenum inlet with a pressurized supply of ambient air, said exhaust enhancement apparatus producing at least one curtain jet by flowing the pressurized air through said distribution channel and out through the plurality of apertures, wherein the ambient air supply includes a fan module, containing a blower and an air inlet grill in a housing thereof, attached to the plenum, the exhaust enhancement apparatus is a self-contained unit constructed for retro-fit attachment as a unit to an exterior surface of the exhaust hood, the plenum being separate from the hood and attached external to the exhaust hood opposite the recess and extending along the front edge of the exhaust hood in a horizontal direction along a longitudinal dimension thereof as well as horizontally away from the recess in a direction perpendicular to said longitudinal dimension, the at least one curtain jet emanates from the plurality of apertures at a location spaced from the exhaust hood front edge, wherein the ambient air supply has a low profile and lies against an outer surface of the exhaust hood with the air inlet grill on an outwardly facing side thereof.

2. An exhaust enhancement apparatus according to claim 1, wherein the plenum apertures face at an angle diagonally downwardly and away from an interior of the exhaust hood.

3. An exhaust enhancement apparatus according to claim 1, wherein the plenum apertures are arranged to form at least one curtain jet.

4. An exhaust enhancement apparatus according to claim 2, wherein the plenum apertures are arranged to form at least one curtain jet.

5. An exhaust enhancement apparatus according to claim 1, wherein the ambient air supply has an air inlet attached to the plenum and positioned on the exhaust hood facing outwardly when the plenum is attached to the exhaust hood.

6. An exhaust enhancement apparatus according to claim 2, wherein the ambient air supply has an air inlet attached to the plenum and positioned on the exhaust hood facing outwardly when the plenum is attached to the exhaust hood.

7. An exhaust enhancement apparatus according to claim 3, wherein the ambient air supply has an air inlet attached to the plenum and positioned on the exhaust hood facing outwardly when the plenum is attached to the exhaust hood.

8. An exhaust enhancement apparatus according to claim 1, wherein the ambient air supply has a flow controller coupled to the fan module and configured to permit a flow of air supplied to the plenum inlet to be adjusted based on the exhaust flow rate of the exhaust hood.

9. An exhaust enhancement apparatus according to claim 2, wherein the ambient air supply has a flow controller coupled to the fan module and configured to permit a flow of air supplied to the plenum inlet to be adjusted based on the exhaust flow rate of the exhaust hood.

10. An exhaust enhancement apparatus according to claim 3, wherein the ambient air supply has a flow controller coupled to the fan module and configured to permit a flow of air supplied to the plenum inlet to be adjusted based on the exhaust flow rate of the exhaust hood.

11. An exhaust enhancement apparatus according to claim 1, wherein the exhaust hood partially covers an appliance in a top-down view, the appliance having a movable platen, in said top-down view, the front edge of the exhaust hood is positioned between a forward edge of the platen and a rear edge of the platen when the platen is closed, and the at least one curtain jet is projected at an angle away from the exhaust hood recess such that the at least one curtain jet passes immediately adjacent to and clearing the forward edge of the platen when the platen is open.

12. An exhaust enhancement apparatus according to claim 2, wherein the exhaust hood partially covers an appliance in a top-down view, the appliance having a movable platen, in said top-down view, the front edge of the exhaust hood is positioned between a forward edge of the platen and a rear edge of the platen when the platen is closed, and the at least one curtain jet is projected at an angle away from the exhaust hood recess such that the at least one curtain jet passes immediately adjacent to and clearing the forward edge of the platen when the platen is open.

13. An exhaust enhancement apparatus according to claim 1, wherein the plenum is positioned such that it extends the exhaust hood when attached thereto.

* * * * *